US005894850A

United States Patent [19]

Kimura

[11] Patent Number: 5,894,850

[45] Date of Patent: Apr. 20, 1999

[54] HAIR HOLDING DEVICE

[75] Inventor: Yoshio Kimura, Osaka, Japan

[73] Assignee: Lucky Corporation Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/766,907

[22] Filed: Dec. 13, 1996

[30] Foreign Application Priority Data

Dec. 15, 1995 [JP] Japan ..... 7-327395
Nov. 28, 1996 [JP] Japan ..... 8-318092

[51] Int. Cl.[6] ..... A45D 8/26

[52] U.S. Cl. ..... 132/279

[58] Field of Search ..... 132/275, 278, 132/279, 273, 276, 277

[56] References Cited

U.S. PATENT DOCUMENTS

| | | | |
|---|---|---|---|
| 673,448 | 5/1901 | Potter | 132/277 |
| 2,317,930 | 4/1943 | McFadden | 132/279 |
| 2,464,739 | 3/1949 | Solomon et al. | 132/277 |
| 3,106,215 | 10/1963 | Grandis et al. | 132/277 |
| 3,279,479 | 10/1966 | Solomon | 132/277 |
| 3,991,774 | 11/1976 | Wolfthal | 132/277 |
| 4,919,155 | 4/1990 | Yasuda | 132/278 |
| 4,976,277 | 12/1990 | Yasuda | 132/279 |
| 5,259,405 | 11/1993 | Hua-Chou | 132/279 |
| 5,495,862 | 3/1996 | Dewing | 132/278 |
| 5,605,166 | 2/1997 | Chou | 132/275 |
| 5,609,169 | 3/1997 | Yang | 132/279 |
| 5,638,836 | 6/1997 | Yasuda | 132/273 |

FOREIGN PATENT DOCUMENTS

| | | | |
|---|---|---|---|
| 507281 | 9/1920 | France | 132/279 |
| 511193 | 12/1920 | France | 132/279 |
| 1339446 | 8/1963 | France | 132/277 |

*Primary Examiner*—Todd E. Manahan
*Assistant Examiner*—Eduardo C. Robert
*Attorney, Agent, or Firm*—Koda & Androlia

[57] ABSTRACT

A hair holding device comprises an upper holding body (1) having an upper holding portion (1*a*) and an upper grip portion (1*b*) which are connected to form a single body, and a lower holding body (2) having a lower holding portion (2*a*) and a lower grip portion (2*b*) which are connected to form a single body, wherein either one of the upper and lower grip portions (1*b*) and (2*b*) is provided with a protrudent spring (4) which comes into contact with the other one. The upper and lower holding portion (1*a*) and (2*a*) are forced to move toward each other by a simple structure of the device, whereby the assembly takes a short time and the manufacturing cost is low.

10 Claims, 21 Drawing Sheets

HAIR HOLDING DEVICE

BACKGROUND OF THE INVENTION

1. Field of the Invention

The present invention relates to a device for holding hair, such as a barrette or a hair clip, which is used when or after setting hair.

2. Description of the Prior Art

A conventional hair clip comprises, for example, a linear-type coil spring 20 supported by an axis between an upper holding body 1 and a lower holding body 2, as shown in FIGS. 27 and 28. The upper holding body 1 consists of an upper holding portion 1*a* and an upper grip portion 1*b* which are connected to form a single body. At the connected portion of the upper holding portion 1*a* and the upper grip portion 1*b*, a pair of fixing parts 1*c* are formed on both lateral sides of the upper holding body 1. The lower holding body 2 consists of a lower holding portion 2*a* and a lower grip portion 2*b* which are connected to form a single body. At the connected portion of the lower holding portion 2*a* and the lower grip portion 2*b*, a pair of fixing parts 2*c* are formed on both lateral sides of the lower holding body 2. The fixing parts 1*c* of the upper holding body 1 and the fixing parts 2*c* of the lower holding body 2 are placed to overlap each other so that a pin 9 is inserted into holes 7 formed on the fixing parts 1*c* and holes 8 formed on the fixing parts 2*c*. A coil part 20*a* of the coil spring 20 is supported by the pin 9 while both ends 20*b* of the coil spring 20 press against the upper grip portion 1*b* of the upper holding body 1 and the lower grip portion 2*b* of the lower holding body 2 respectively. In this arrangement, the upper holding portion 1*a* and the lower holding portion 2*a* are forced to move toward each other due to the elasticity of the coil spring 20.

In the assembly process, both ends 20*b* of the coil spring 20 are placed to press against the upper and lower grip portions 1*b* and 2*b* while the pin 9 is inserted through the holes 7 and 8 and the coil part 20*a*, as illustrated by the alternate long and short dash line in FIG. 27. Therefore, the conventional hair clip is disadvantaged in that it is difficult to insert the coil spring 20 between the upper grip portion 1*b* and the lower grip portion 2*b* and thus the assembly takes a long time.

Furthermore, when hair is placed between the upper holding portion 1*a* and the lower holding portion 2*a*, the free end of the upper holding portion 1*a* does not contact the free end of the lower holding portion 2*a*. Therefore, the conventional hair clip does not hold hair steadily and thus placed hair easily falls out of the free end of the hair clip.

A conventional barrette as shown in FIG. 29 comprises an upper holding body 1 made of synthetic resin or other substances and an oblong lower holding body 2 made of elastic metal. One end of the lower holding body 2 is connected rotatably to one end of the upper holding body 1. An oblong press plate 21 made of elastic metal is provided on the bottom surface of the upper holding body 1 to face the lower holding body 2. A catch part 22 is provided on the other end of the upper holding body 1 and a snap part 23 is provided on the other end of the lower holding body 2 so as to form a snap mechanism 24. The snap mechanism 24 provides the releasable engagement of the end of the upper holding body 1 and the end of the lower holding body 2.

When the engaged ends of the upper and lower holding bodies 1 and 2 are released, the lower holding body 2 moves far away from the upper holding body 1 to hang and waver. Therefore, the conventional barrette requires the lower holding body 2 to be supported by hand in order to make the space required before hair is placed, resulting in an inconvenience for the user.

SUMMARY OF THE INVENTION

It is an object of the present invention to solve the above difficulties and problems of conventional hair clips and barrettes and provide a hair holding device having a simple structure, whereby the assembly thereof does not take a long time. The simple structure provides elasticity which causes an upper holding portion 1*a* of an upper holding body 1 and a lower holding portion 2*a* of a lower holding portion 2 to move toward each other.

It is another object of the present invention to provide a hair holding device wherein a free end of the upper holding portion 1*a* and a free end of the lower holding portion 2*a* are kept a certain distance from each other when an upper grip portion 1*b* of the upper holding body 1 and a lower grip portion 2*b* of the lower holding body 2 are not pressed.

It is a further object of the present invention to provide a hair holding device wherein the free end of the upper holding portion 1*a* and the free end of the lower holding portion 2*a* are engaged with each other by a simple operation after hair is placed between them so as to hold hair steadily and prevent hair from falling out.

A hair holding device of the present invention comprises an upper holding body 1 having an upper holding portion 1*a* and an upper grip portion 1*b* which are connected to form a single body, and a lower holding body 2 having a lower holding portion 2*a* and a lower grip portion 2*b* which are connected to form a single body, wherein either one of the upper and lower grip portions 1*b* and 2*b* is provided with a protrudent spring 4 which comes into contact with the other one of the upper and lower grip portions 1*b* and 2*b*.

Another hair holding device of the present invention comprises an upper holding body 1 having an upper holding portion 1*a* and an upper grip portion 1*b* which are connected to form a single body, and a lower holding body 2 having a lower holding portion 2*a* and a lower grip portion 2*b* which are connected to form a single body, wherein both of the upper and lower grip portions 1*b* and 2*b* are provided with protrudent springs 4 in contact with each other.

A hair holding device of the present invention may further comprise a stopper mechanism 10, whereby a free end of the upper holding portion 1*a* and a free end of the lower holding portion 2*a* are kept a certain distance from each other when the upper grip portion 1*b* and the lower grip portion 2*b* are not pressed.

A hair holding device of the present invention may further comprise a snap mechanism 17, whereby the free end of the lower holding portion 2*a* is releasably engaged with the free end of the upper holding portion 1*a*.

Both the upper holding body 1 and the lower holding body 2 of the hair holding device of the present invention may be made of metal.

Both the upper holding body 1 and the lower holding body 2 of the hair holding device of the present invention may be made of synthetic resin.

Either one of the upper holding body 1 and the lower holding body 2 of the hair holding device of the present invention may be made of metal, while the other one may be made of synthetic resin.

DETAILED DESCRIPTION OF THE PREFERRED EMBODIMENTS

Preferred embodiments of the present invention will now be described in detail in reference to the accompanying drawings.

Figure 1:
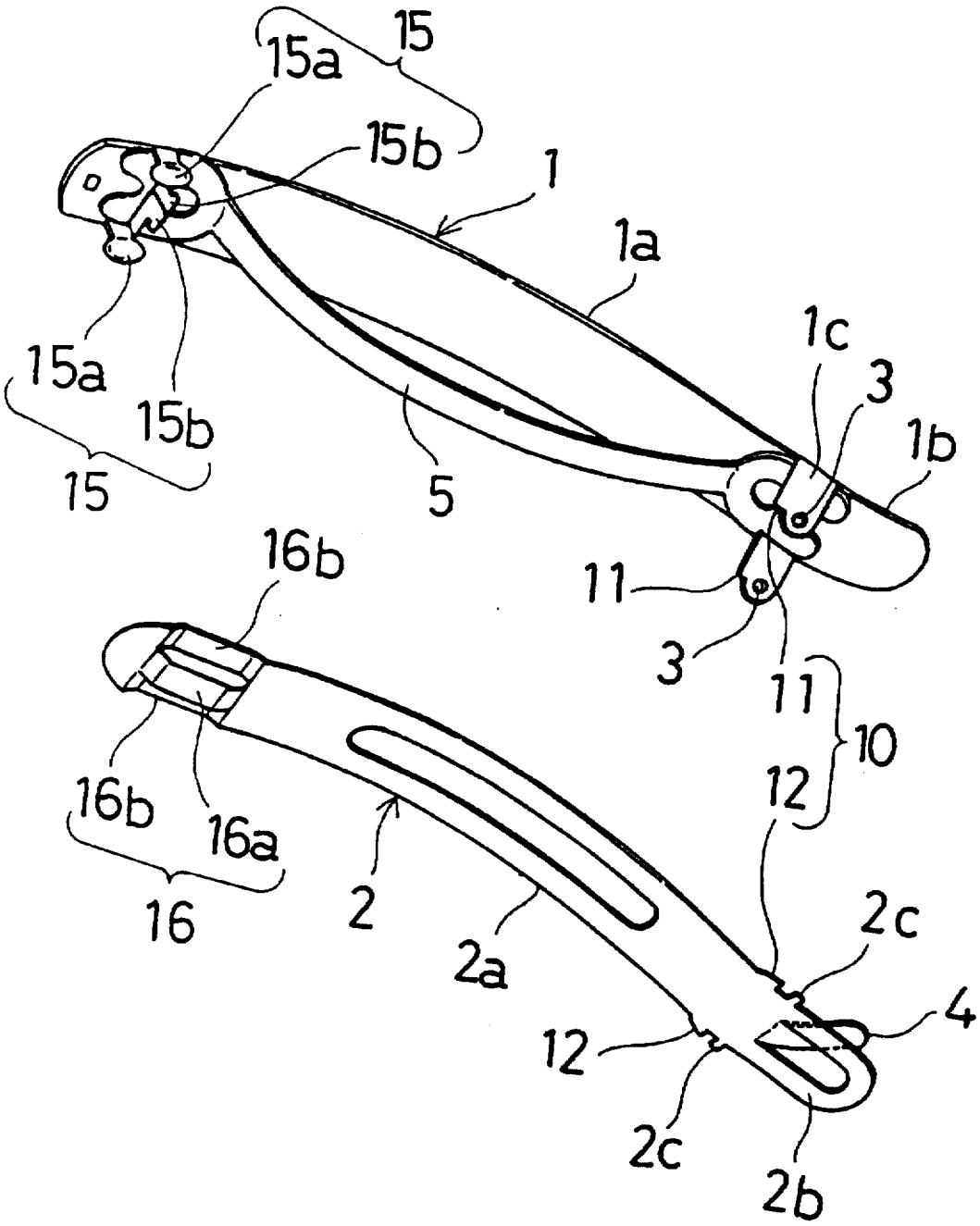
FIG. 1 is an exploded perspective view showing one embodiment of a hair holding device according to the present invention.
Figure 2:
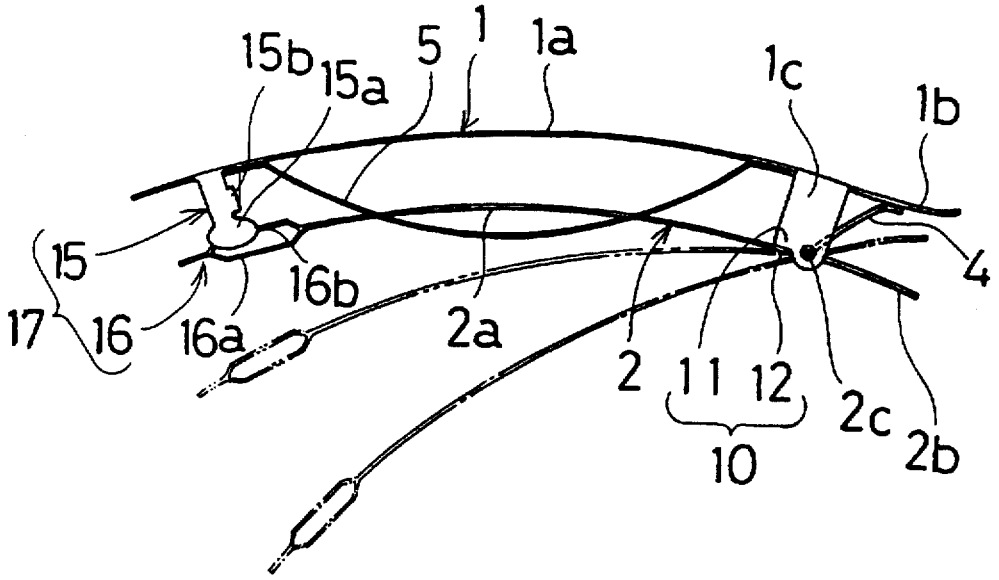
FIG. 2 is a side view of the hair holding device shown in FIG. 1.
Figure 3:
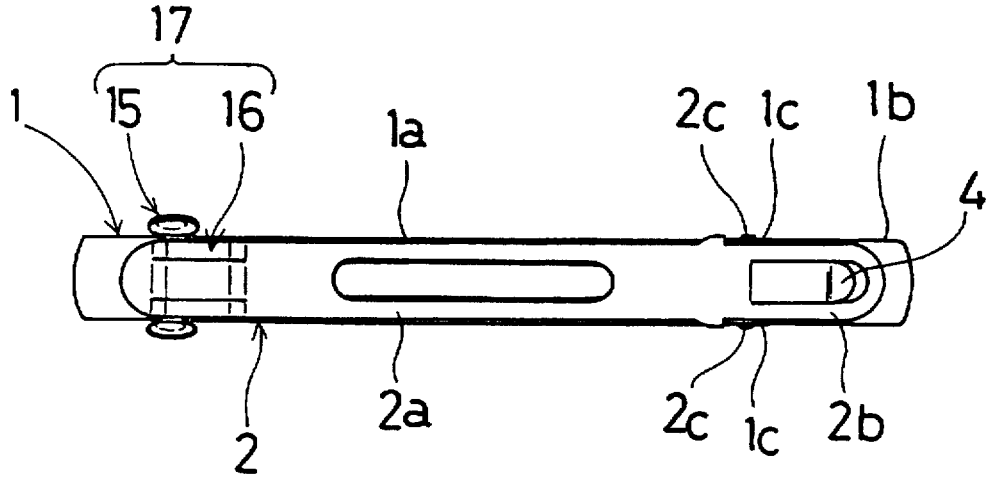
FIG. 3 is a bottom plan view of the hair holding device shown in FIG. 1.

In accordance with one embodiment of the present invention as shown in FIGS. 1 through 3, a hair holding device comprises an upper holding body 1 and a lower holding body 2. The upper holding body 1 comprises an upper holding portion 1*a* and an upper grip portion 1*b* which are connected to form a single body. At the connected portion of the upper holding portion 1*a* and the upper grip portion 1*b*, a pair of fixing arms 1*c* are formed on both lateral sides of the upper holding body 1. The lower holding body 2 comprises a lower holding portion 2*a* and a lower grip portion 2*b* which are connected to form a single body. At the connected portion of the lower holding portion 2*a* and the lower grip portion 2*b*, a pair of projections 2*c* are formed on both lateral sides of the lower holding body 2. The projections 2*c* are inserted rotatably into holes 3 provided on the fixing arms 1*c*, respectively.

The upper holding body 1 is formed into a curved oblong plate made of elastic material such as elastic metal. The lower holding body 2 is formed into an oblong plate made of elastic material such as elastic metal, which is curved along the upper holding body 1.

Figure 4:
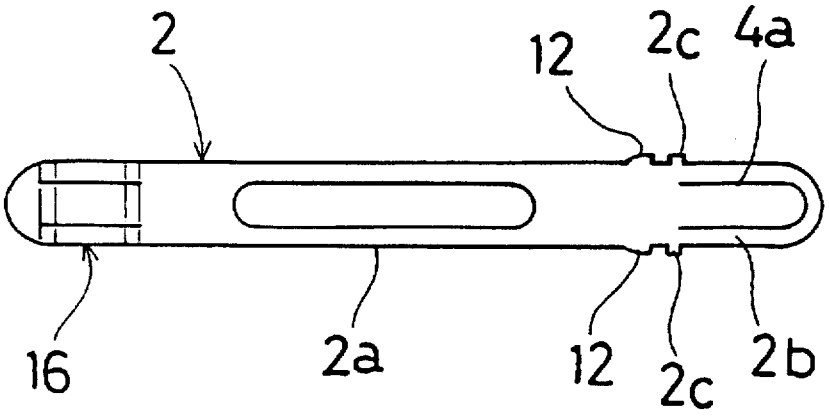
FIG. 4 is an explanatory diagram of one variation of an incision formed on a lower holding body of the hair holding device shown in FIG. 1.
Figure 5:
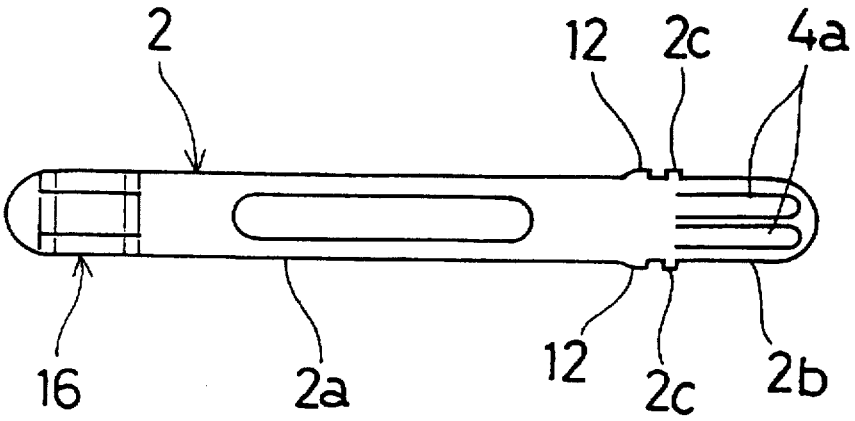
FIG. 5 is an explanatory diagram of the second variation of an incision formed on a lower holding body of the hair holding device shown in FIG. 1.
Figure 6:
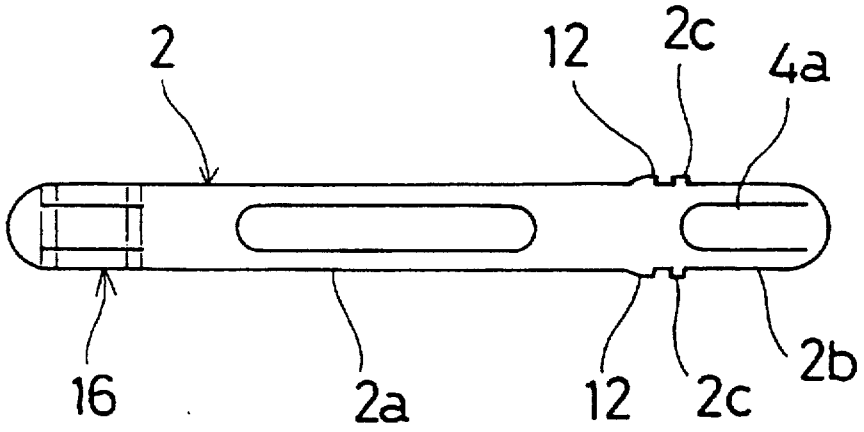
FIG. 6 is an explanatory diagram of the third variation of an incision formed on a lower holding body of the hair holding device shown in FIG. 1.
Figure 7:
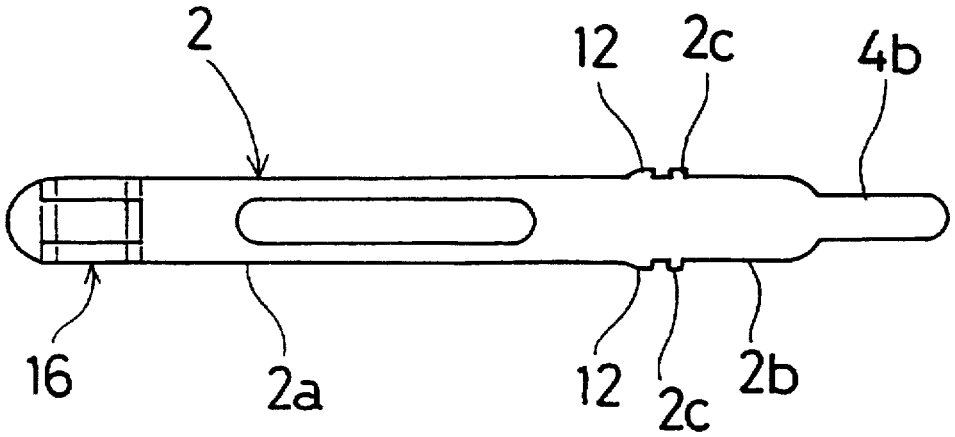
FIG. 7 is an explanatory diagram of a tongue formed on a lower holding body of the hair holding device shown in FIG. 1.
Figure 8:
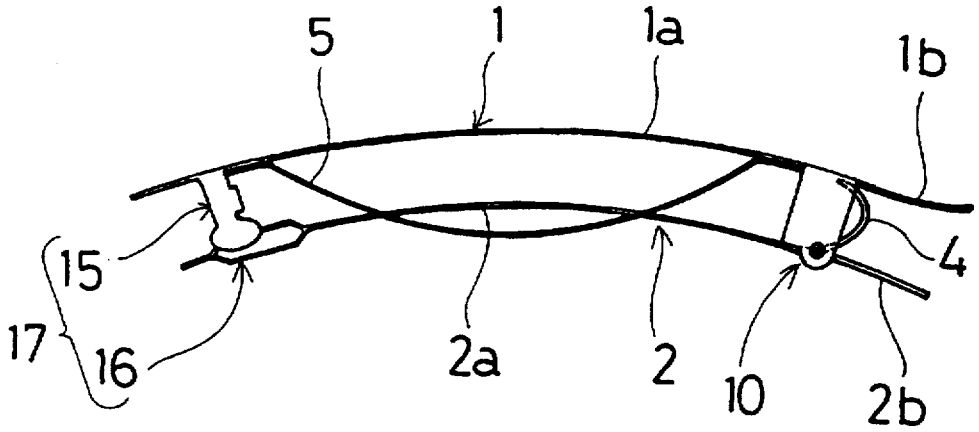
FIG. 8 is a side view showing one modified embodiment of the hair holding device shown in FIG. 1.
Figure 9:
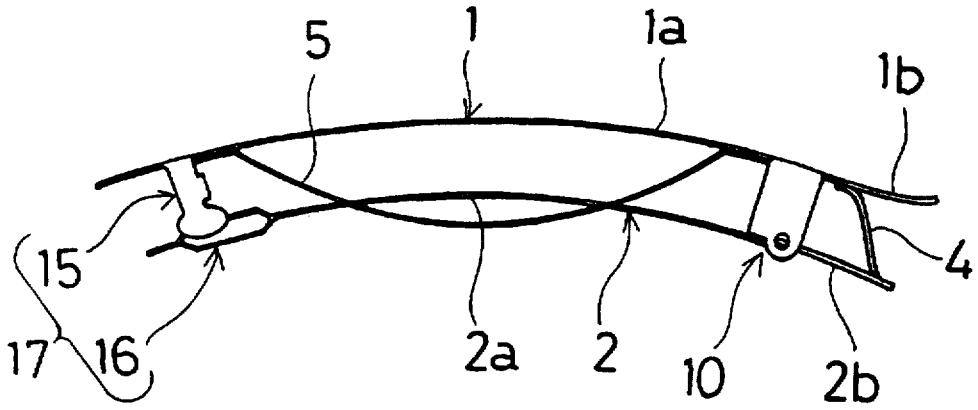
FIG. 9 is a side view showing the second modified embodiment of the hair holding device shown in FIG. 1.
Figure 10:
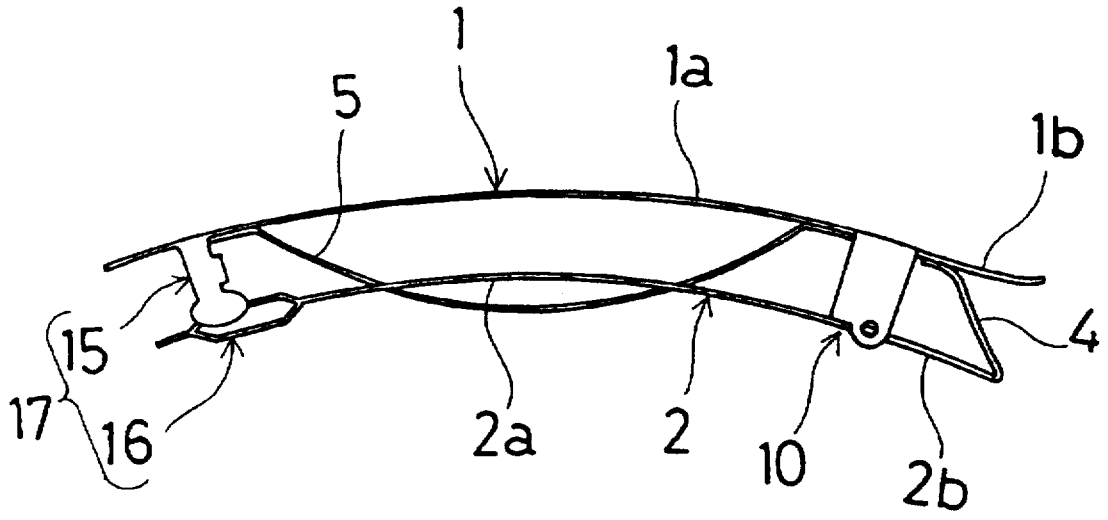
FIG. 10 is a side view showing the third modified embodiment of the hair holding device shown in FIG. 1.

An incision 4*a* as shown in FIGS. 4, 5 or 6 or a tongue 4*b* as shown in FIG. 7 is formed on the lower grip portion 2*b* of the lower holding body 2. The incision 4*a* or the tongue 4*b* is bent to come into contact with the bottom face of the upper grip portion 1*b* of the upper holding body 1, as shown in FIGS. 2, 8, 9 or 10, so as to form a protrudent plate-shaped spring 4. In this arrangement, the upper holding portion 1*a* and the lower holding portion 2*a* are forced to move toward each other due to the elasticity of the spring 4.

The incision 4*a* or the tongue 4*b* may be formed on the upper grip portion 1*b* of the upper holding body 1 and bent to come into contact with the top face of the lower grip portion 2*b* of the lower holding body 2 so as to form a protrudent plate-shaped spring 4. Alternatively, upper and lower springs 4 may be provided on both the upper grip portion 1*b* and the lower grip portion 2*b* respectively so as to come into contact with each other.

The upper holding body 1 may be further provided with a press part 5 between the upper holding body 1 and the lower holding body 2, as shown in FIGS. 1 and 2. Alternatively, not the upper holding body 1 but the lower holding body 2 may be provided with the press part 5.

Figure 11:
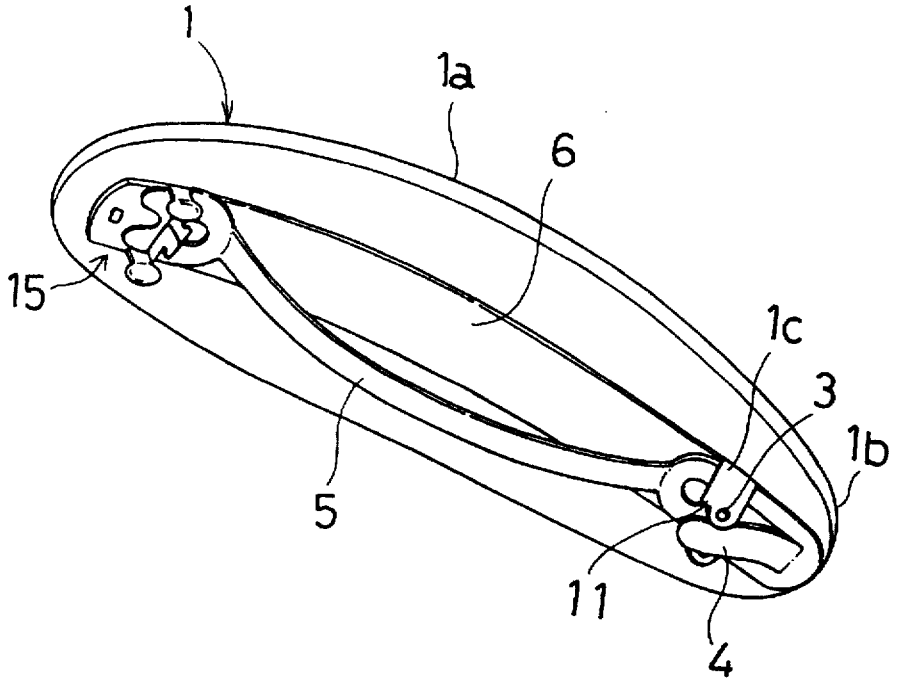
FIG. 11 is a perspective view showing one embodiment of an upper holding body of the hair holding device shown in FIG. 1.
Figure 12:
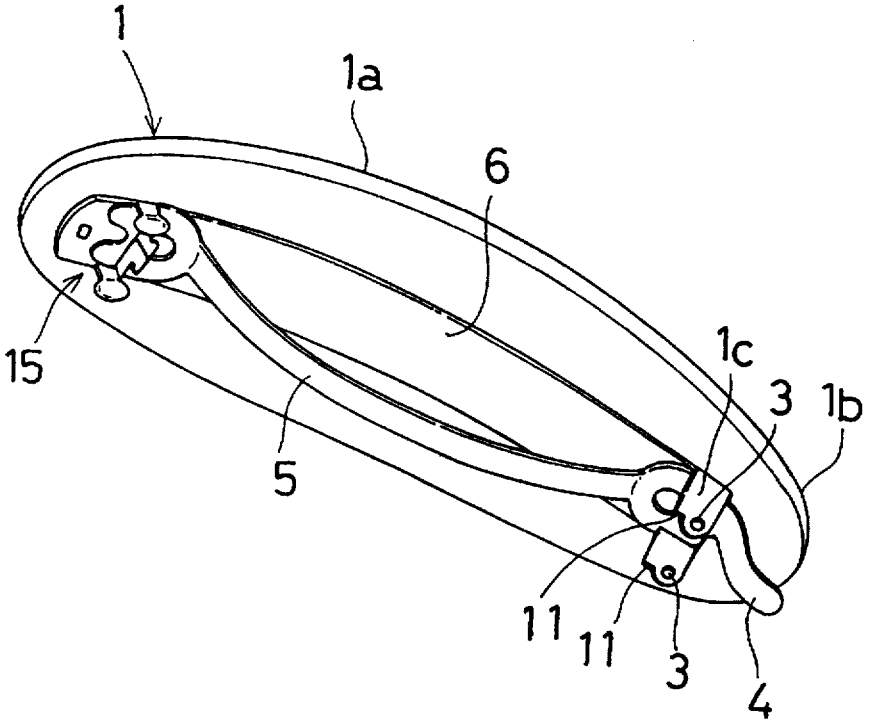
FIG. 12 is a perspective view showing another embodiment of an upper holding body of the hair holding device shown in FIG. 1.

As shown in FIGS. 11 and 12, an upper holding body 1 of a hair holding device of the invention may be formed into a curved oblong plate made of synthetic resin. An elastic body 6 such as an elastic metal plate is attached to the bottom surface of the upper holding body 1. An incision or a tongue is formed on one end of the elastic body 6 and bent to come into contact with the top face of a lower grip portion 2*b* of a lower holding body 2 so as to form a protrudent spring 4. As shown in FIG. 12, instead of providing an incision or a tongue, one end of the elastic body 6 may be narrowed. The narrow end of the elastic body 6 is bent to come into contact with the top face of the lower grip portion 2*b* so as to form a protrudent plate-shaped spring 4.

As shown in FIGS. 1 and 2, the hair holding device of the invention further comprises a stopper mechanism 10 between the upper holding body 1 and the lower holding body 2. The stopper mechanism 10 consists of a pair of steps 11 and a pair of stoppers 12. The step 11 is formed on the fixing arm 1*c* of the upper holding body 1. The stopper 12 is formed adjacent to the projection 2*c* on the lower holding body 2. In the stopper mechanism 10, the stoppers 12 contact the steps 11 when the upper and lower grip portions 1*b* and 2*b* are not pressed, whereby the free end of the upper holding portion 1*a* and the free end of the holding portion 2*a* are kept a certain distance from each other, as illustrated by the alternate double dots and dash line in FIG. 2.

As shown in FIG. 2, the hair holding device of the invention still further includes a snap mechanism 17 which consists of a catch part 15 provided on the end of the upper holding portion 1*a* of the upper holding body 1 and a snap part 16 provided on the end of the lower holding portion 2*a* of the lower holding body 2. The snap mechanism 17 releasably engages the end of the upper holding portion 1*a* and the end of the lower holding portion 2*a*.

As shown in FIG. 1, the catch part 15 comprises a pair of finger grip arms 15*a* and a pair of catch pieces 15*b*. The finger grip arms 15*a* extend from the lateral sides of the end of the upper holding portion 1*a* toward the lower holding body 2, somewhat outwardly. The catch pieces 15*b* extend from the middle parts of the finger grip arms 15*a* toward each other and are further bent toward the lower holding body 2.

The snap part 16 comprises an inside piece 16*a* and a pair of outside pieces 16*b*. Two longitudinal and parallel incisions are provided on the end of the lower holding portion 2*a* of the lower holding body 2. The separated center part between the two incisions is raised away from the upper holding body 1 to form the inside piece 16*a*. The outside parts of the two incisions are raised toward the upper holding body 1 to form the outside pieces 16*b*.

Before the engagement, the catch part 15 and the snap part 16 are placed as illustrated by the alternate double dots and dash line in FIG. 2. In order to obtain the engagement as illustrated by solid line in FIG. 2, the snap part 16 is pressed against the catch part 15, whereby the catch pieces 15*b* move inward and then the hook ends of the catch pieces 15*b* pass between the outside pieces 16*b* and move outward due to its elasticity to catch the outside pieces 16*b*. In order to release the engagement, the finger grip arms 15*a* are pinched and pressed to move inward, whereby the outside pieces 16*b* are released from the catch pieces 15*b*, as illustrated by the alternate double dots and dash line in FIG. 2.

In accordance with the second embodiment of the present invention as shown in FIGS. 13 through 16, a hair holding device comprises an upper holding body 1 and a lower holding body 2. The upper holding body 1 comprises an upper holding portion 1*a* and an upper grip portion 1*b* which are connected to form a single body. At the connected portion of the upper holding portion 1*a* and the upper grip portion 1*b*, a pair of fixing parts 1*d* are formed on both lateral sides of the upper holding body 1. The lower holding body 2 comprises a lower holding portion 2*a* and a lower grip portion 2*b* which are connected to form a single body. At the connected portion of the lower holding portion 2*a* and the lower grip portion 2*b*, a pair of fixing parts 2*d* are formed on both lateral sides of the lower holding body 2. The fixing parts 1*d* of the upper holding body 1 and the fixing parts 2*d* of the lower holding body 2 are placed to overlap each other so that a pin 9 is inserted into holes 7 formed on the fixing parts 1*d* and holes 8 formed on the fixing parts 2*d*, whereby the fixing part 1*d* and the fixing part 2*d* are fixed together by an axis.

The upper holding body 1 is formed into a wavy oblong plate made of synthetic resin. The lower holding body 2 is formed into an oblong plate made of elastic material such as elastic metal, which is waved along the upper holding body 1.

Figure 17:
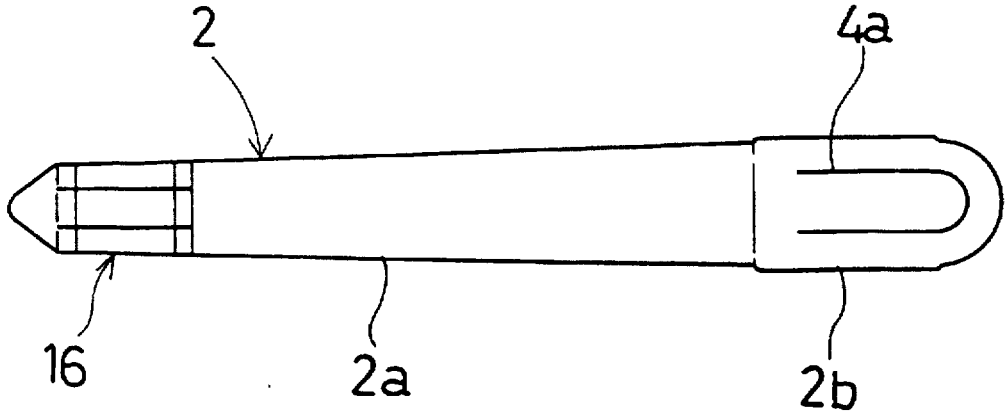
FIG. 17 is an explanatory diagram of one variation of an incision formed on a lower holding body of the hair holding device shown in FIG. 13.
Figure 18:
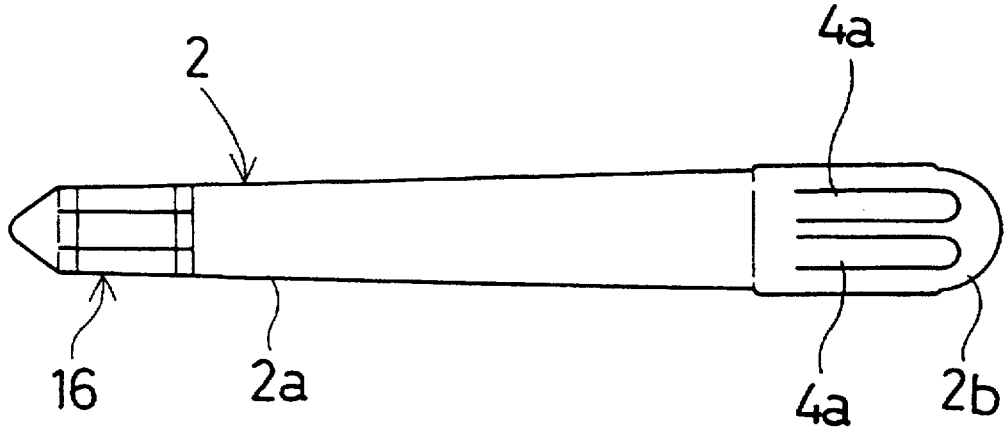
FIG. 18 is an explanatory diagram of the second variation of an incision formed on a lower holding body of the hair holding device shown in FIG. 13.
Figure 19:
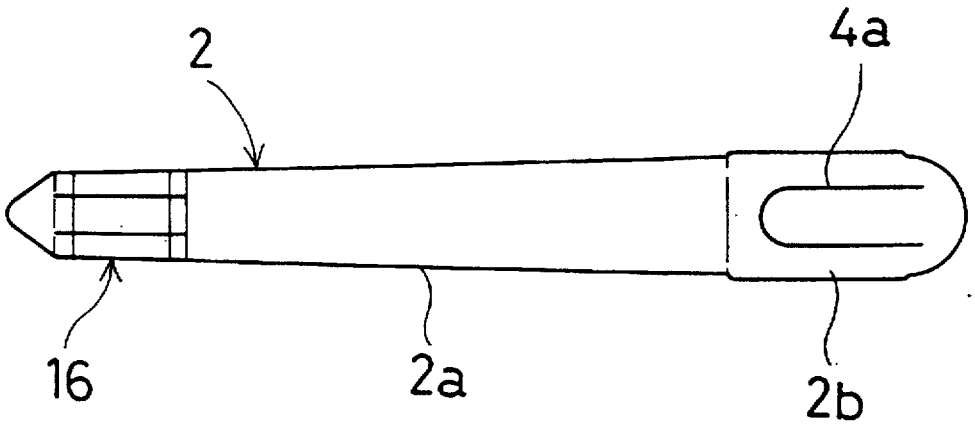
FIG. 19 is an explanatory diagram of the third variation of an incision formed on a lower holding body of the hair holding device shown in FIG. 13.
Figure 20:
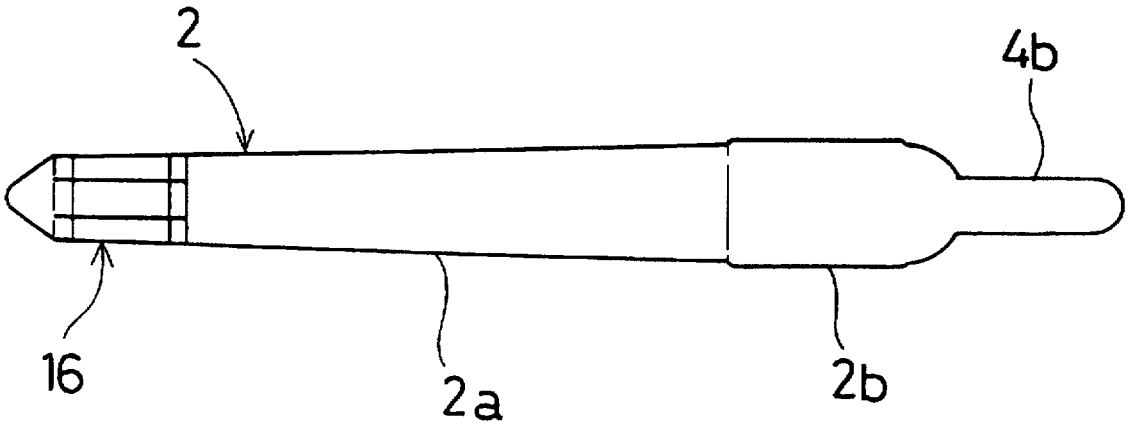
FIG. 20 is an explanatory diagram of a tongue formed on a lower holding body of the hair holding device shown in FIG. 13.
Figure 21:
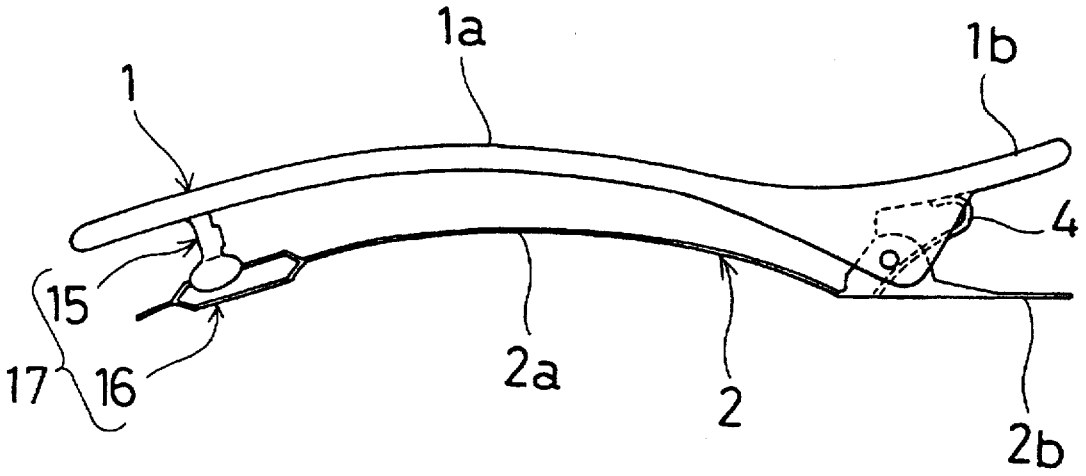
FIG. 21 is a side view showing one modified embodiment of the hair holding device shown in FIG. 13.
Figure 22:
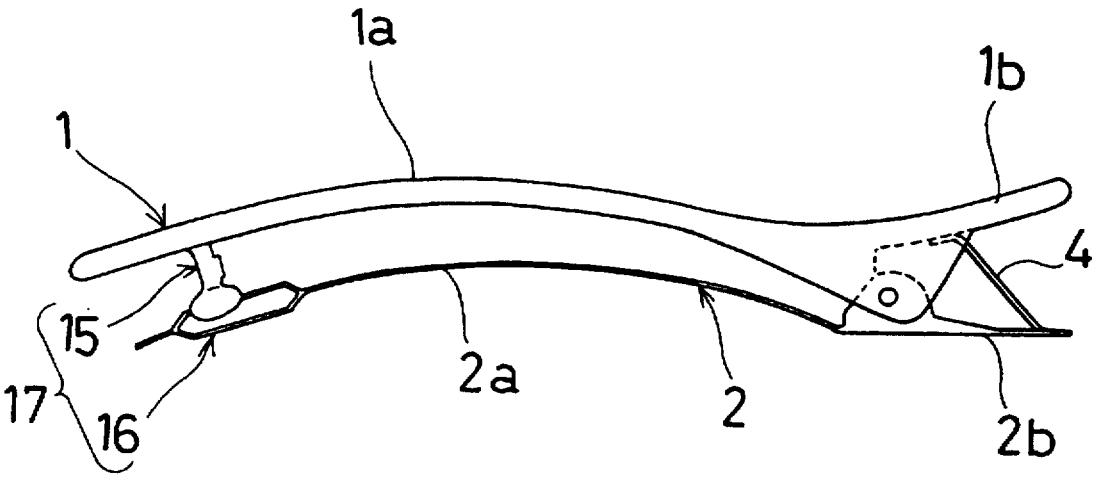
FIG. 22 is a side view showing the second modified embodiment of the hair holding device shown in FIG. 13.
Figure 23:
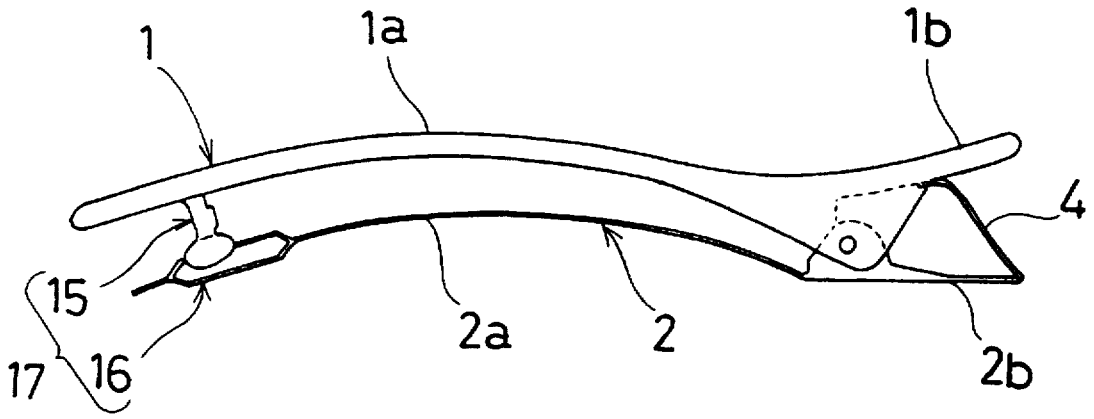
FIG. 23 is a side view showing the third modified embodiment of the hair holding device shown in FIG. 13.

An incision 4*a* as shown in FIGS. 17, 18 or 19 or a tongue 4*b* as shown in FIG. 20 is formed on the lower grip portion 2*b* of the lower holding body 2. The incision 4*a* or the tongue 4*b* is bent to come into contact with the bottom face of the upper grip portion 1*b* of the upper holding body 1, as shown in FIGS. 14, 21, 22 or 23, so as to form a protrudent plate-shaped spring 4. In this arrangement, the upper holding portion 1*a* and the lower holding portion 2*a* are forced to move toward each other due to the elasticity of the spring 4.

Figure 13:
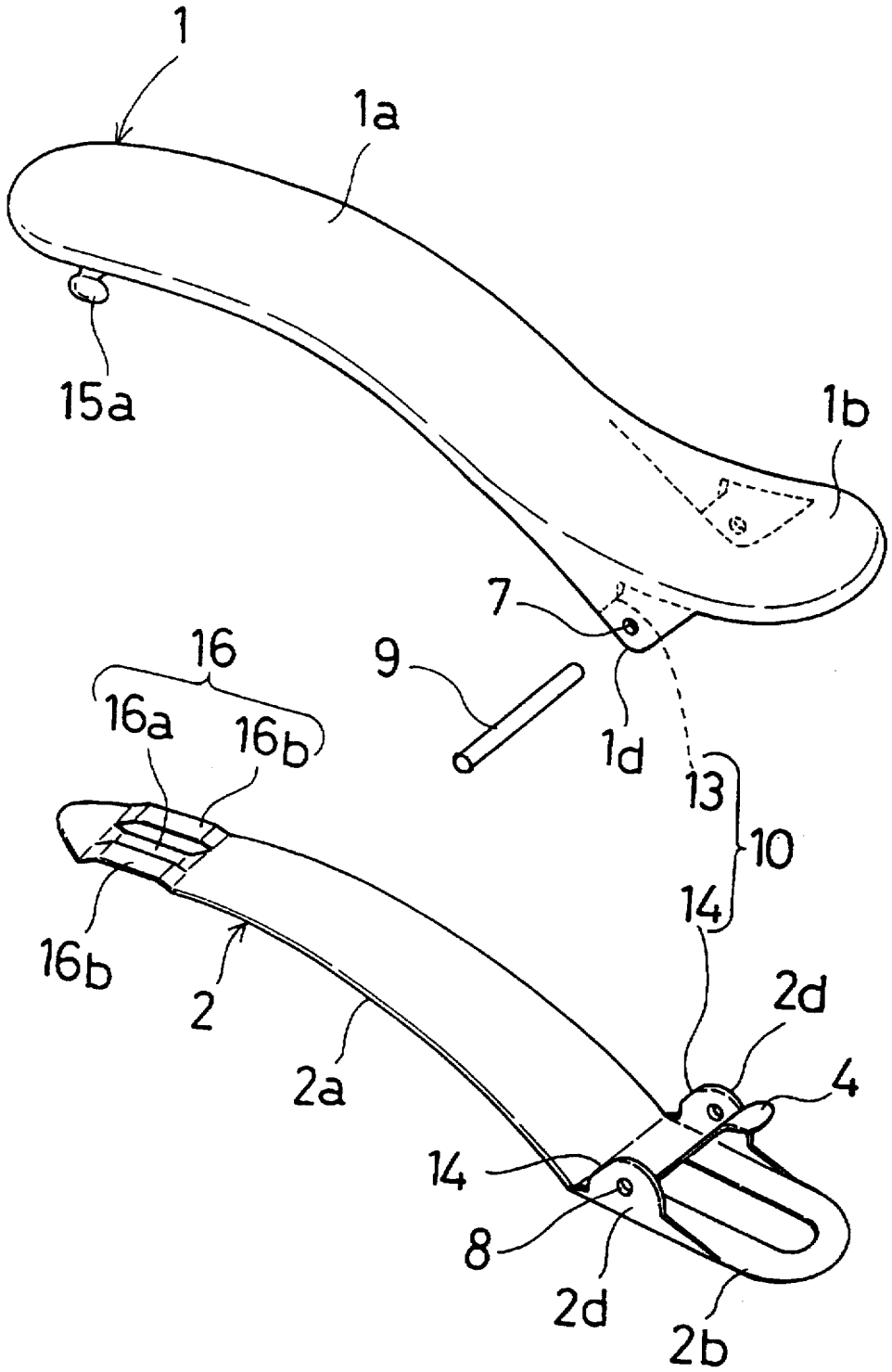
FIG. 13 is an exploded perspective view showing the second embodiment of a hair holding device according to the present invention.
Figure 14:
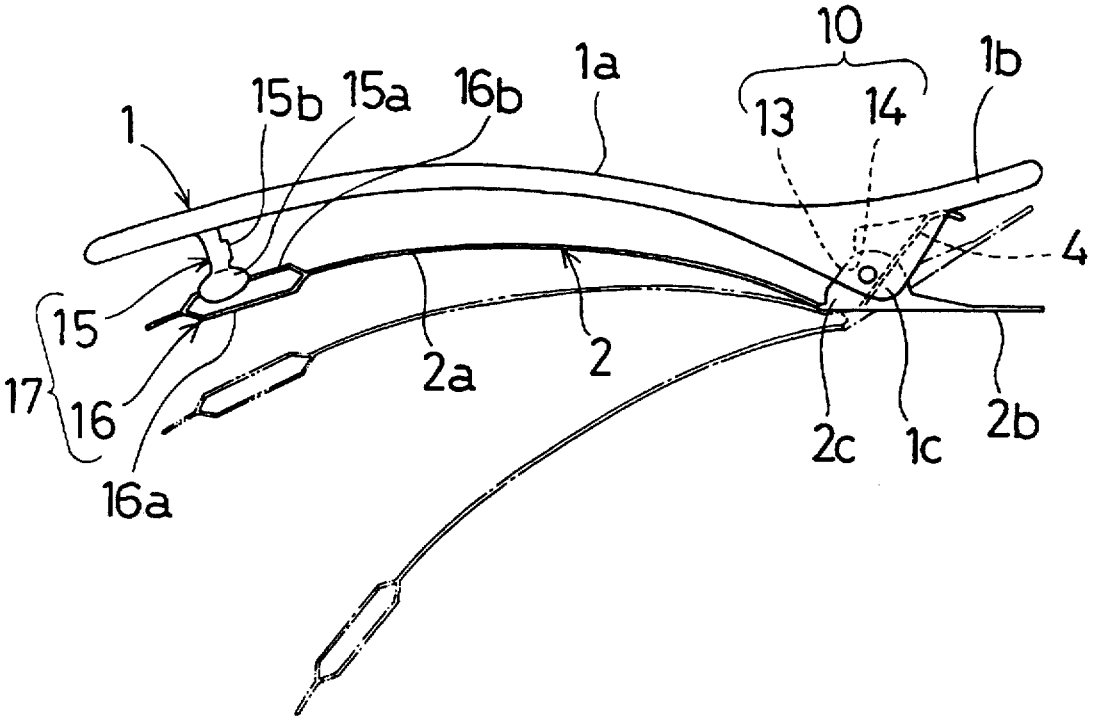
FIG. 14 is a side view of the hair holding device shown in FIG. 13.
Figure 15:
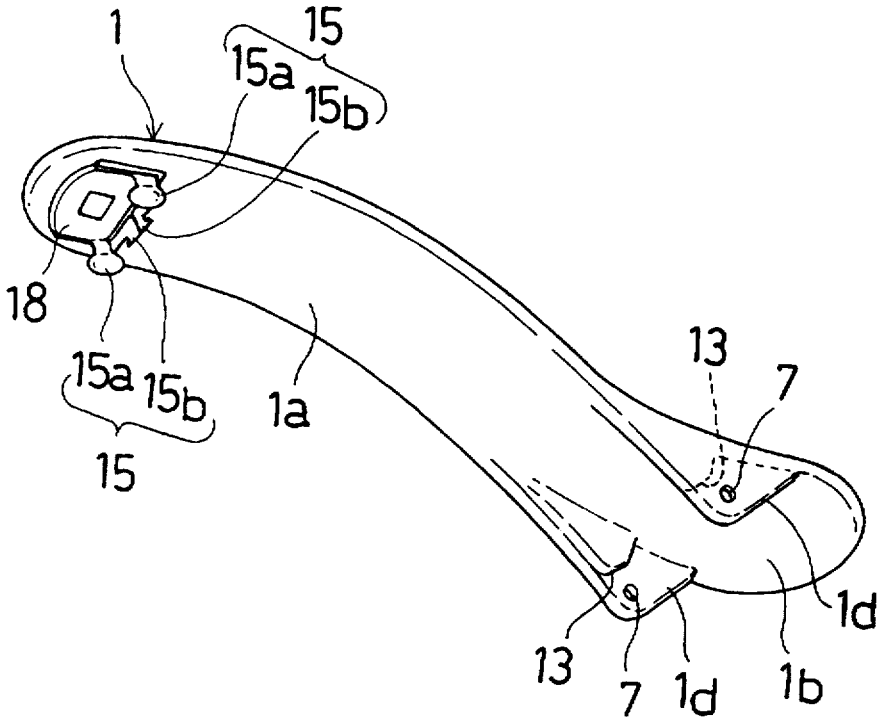
FIG. 15 is a perspective view of an upper holding body of the hair holding device shown in FIG. 13.
Figure 16:
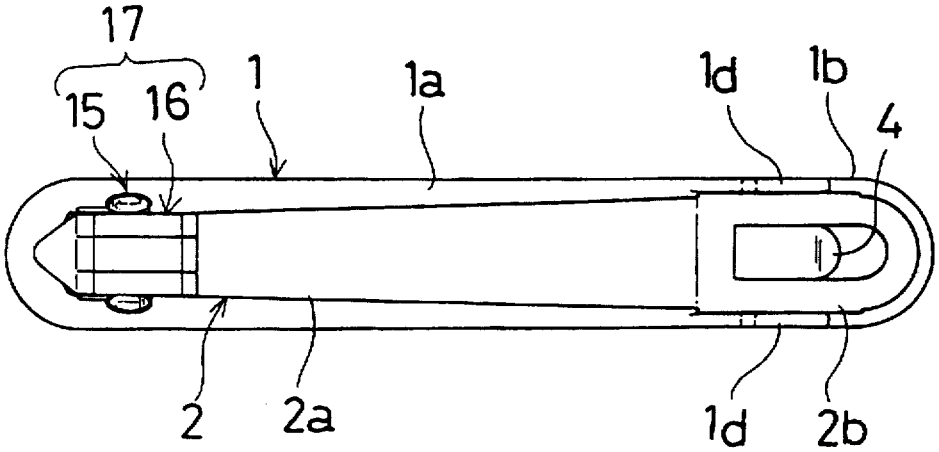
FIG. 16 is a bottom plan view of the hair holding device shown in FIG. 13.

As shown in FIGS. 13 through 15, the hair holding device of the invention further comprises a stopper mechanism 10 between the upper holding body 1 and the lower holding body 2. The stopper mechanism 10 consists of a pair of steps 13 formed on the fixing parts 1*d* of the upper holding body 1 respectively and a pair of edges 1 formed on the fixing parts 2*d* of the lower holding body 2 respectively. In the stopper mechanism 10, the edges 14 contact the steps 13 when the upper and lower grip portions 1*b* and 2*b* are not pressed, whereby the free end of the upper holding portion 1*a* and the free end of the lower holding portion 2*a* are kept a certain distance from each other, as illustrated by the alternate double dots and dash line in FIG. 14.

As shown in FIG. 14, the hair holding device of the invention still further includes a snap mechanism 17 which consists of a catch part 15 provided on the end of the upper holding portion 1*a* and a snap part 16 provided on the end of the lower holding portion 2*a*. The snap mechanism 17 releasably engages the end of the upper holding portion 1*a* and the end of the lower holding portion 2*a*.

As shown in FIG. 15, the catch part 15 comprises a pair of finger grip arms 15*a* and a pair of catch pieces 15*b*. In this embodiment, a plate 18 is attached to the bottom face of the end of the upper holding portion 1*a* of the upper holding body 1. The finger grip arms 15*a* extend from the lateral sides of the plate 18 toward the lower holding body 2, somewhat outwardly. The catch pieces 15*b* extend from the middle parts of the finger grip arms 15*a* toward each other and are further bent toward the lower holding body 2.

As shown in FIG. 13, the snap part 16 is constructed in the same manner as that in the first embodiment. The engagement of the catch part 15 and the snap part 16, in FIG. 14, is obtained and released in the same manner as in the first embodiment.

Figure 24:
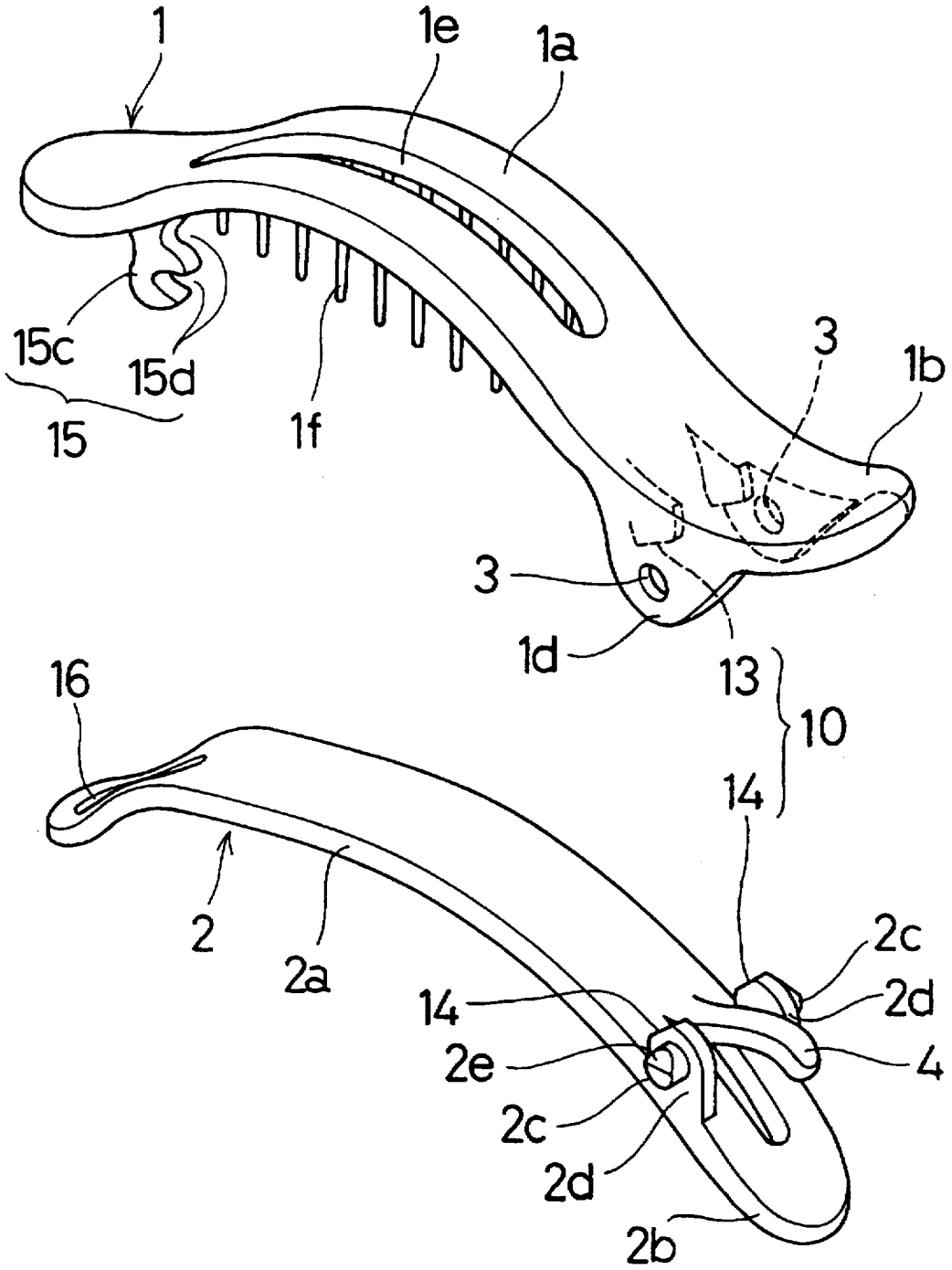
FIG. 24 is an exploded perspective view showing the third embodiment of a hair holding device according to the present invention.
Figure 25:
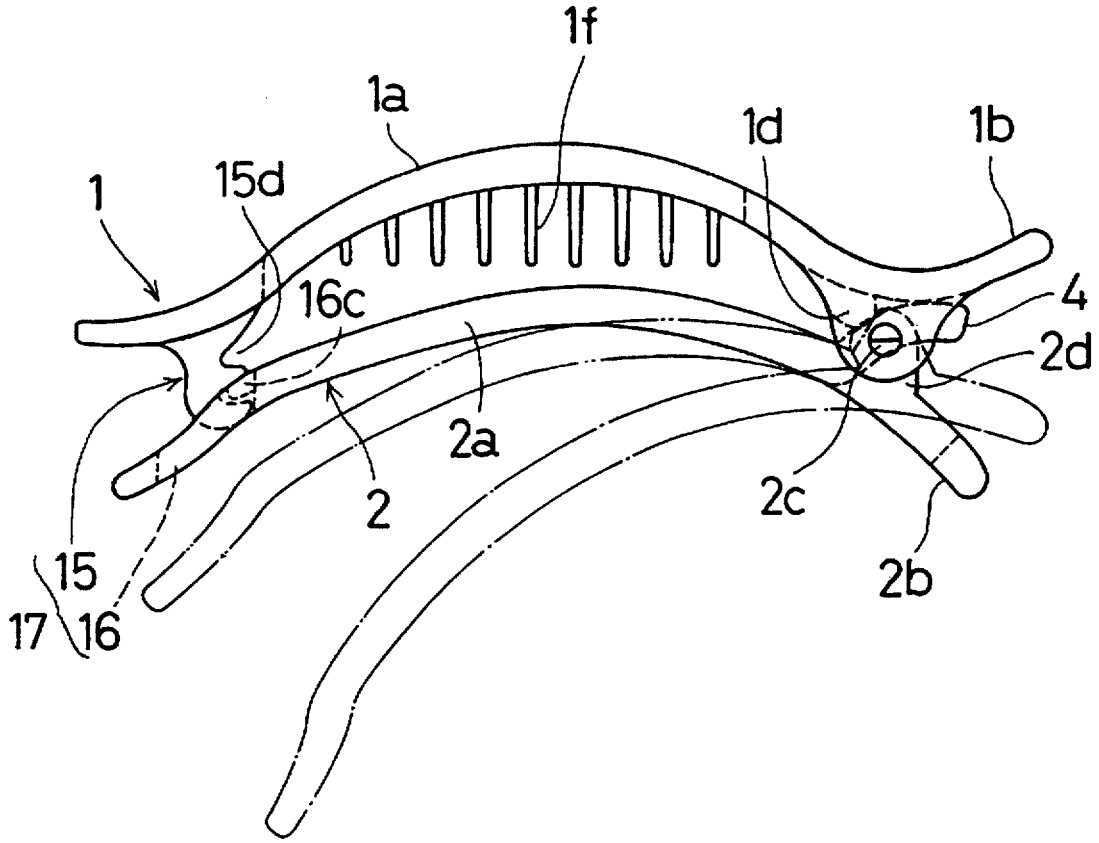
FIG. 25 is a side view of the hair holding device shown in FIG. 24.
Figure 26:
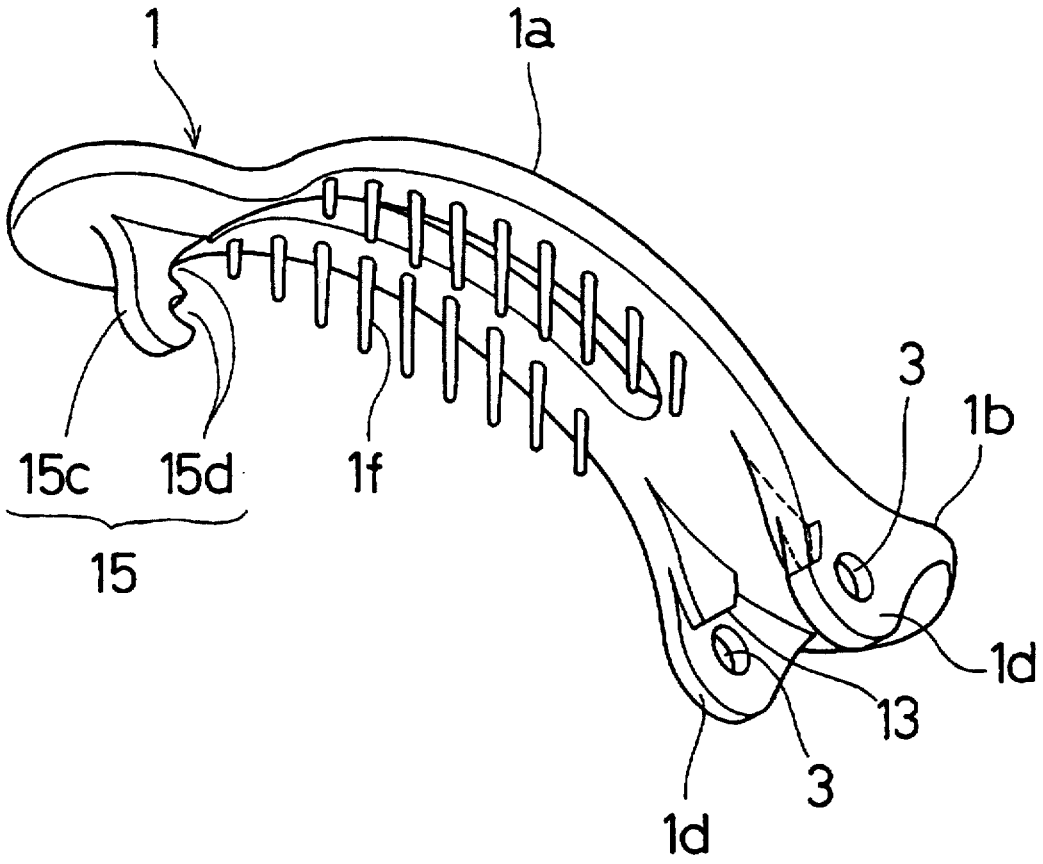
FIG. 26 is a perspective view of an upper holding body of the hair holding device shown in FIG. 24.
Figure 27:
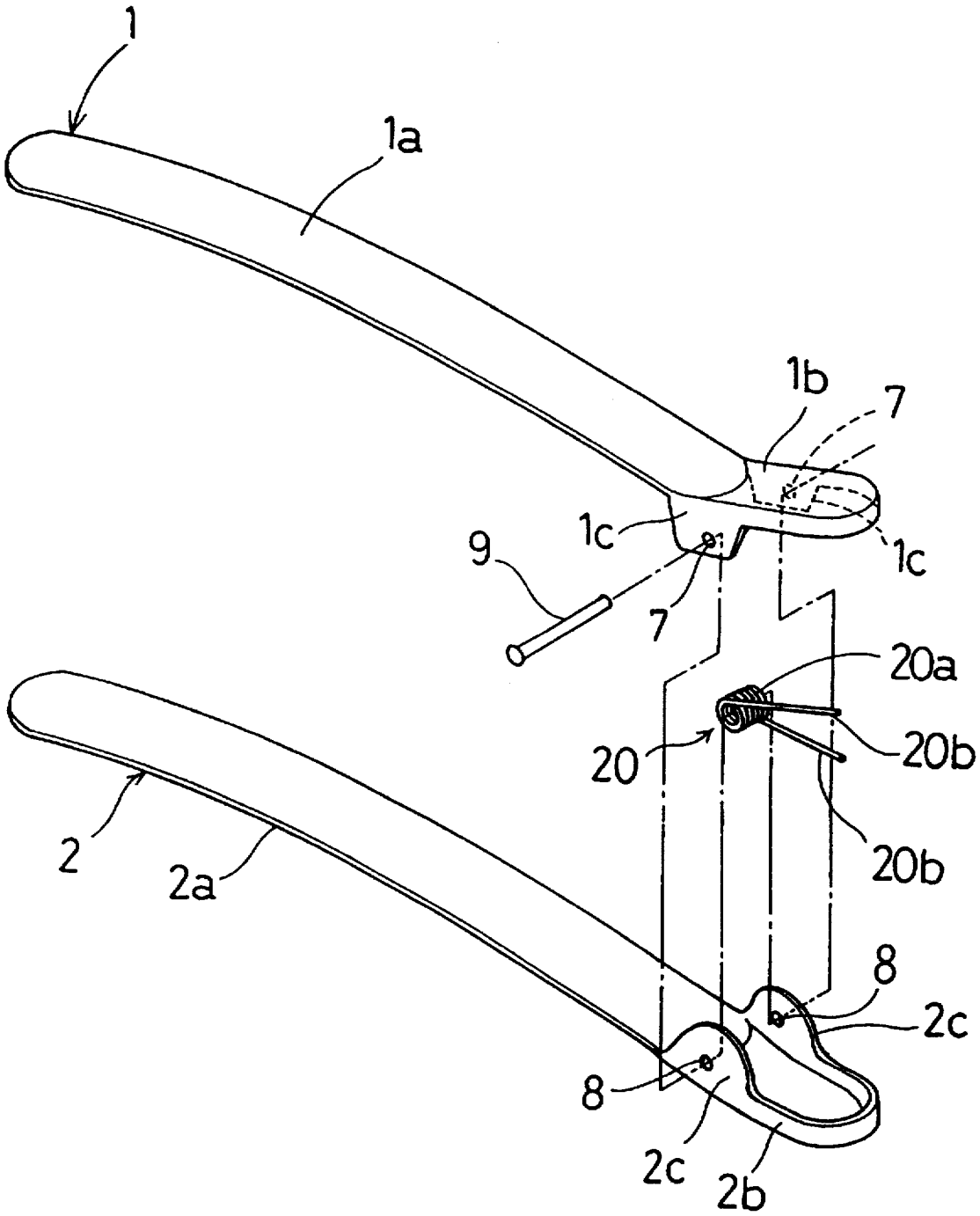
FIG. 27 PRIOR ART
FIG. 27 is an exploded perspective view showing a conventional hair clip.
Figure 28:
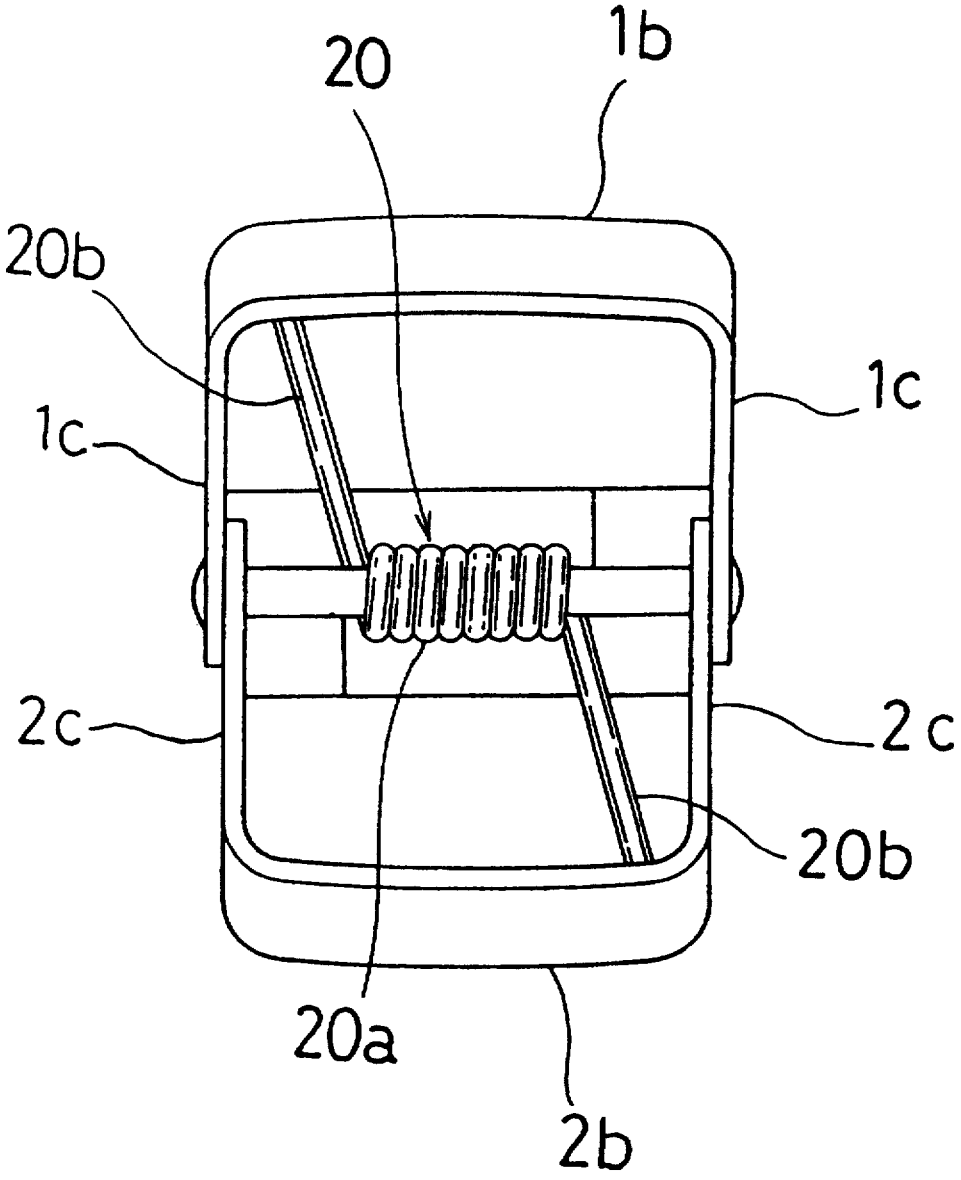
FIG. 28 PRIOR ART
FIG. 28 is a view taken from the grip side of the conventional hair clip shown in FIG. 27.
Figure 29:
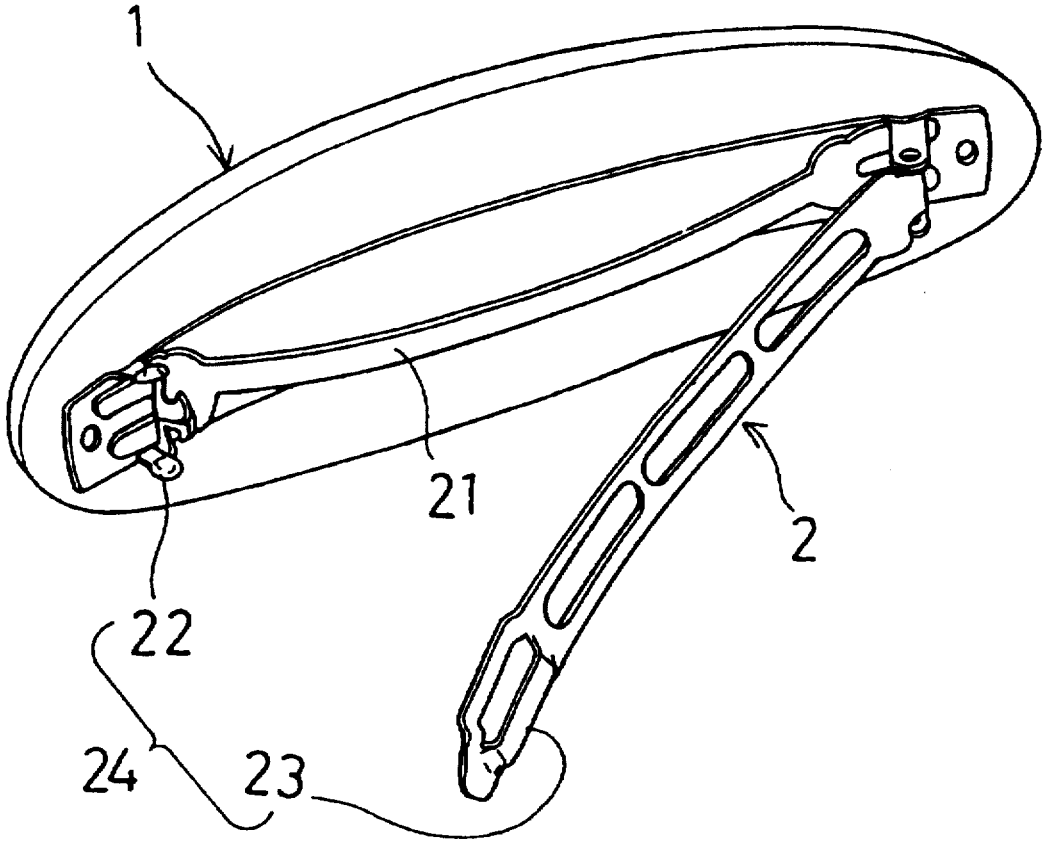
FIG. 29 PRIOR ART
FIG. 29 is a perspective view showing a conventional barrette.

In accordance with the third embodiment of the present invention as shown in FIGS. 24 through 26, a hair holding device comprises an upper holding body 1 and a lower holding body 2. The upper holding body 1 comprises an upper holding portion 1*a* and an upper grip portion 1*b* which are connected to form a single body. At the connected portion of the upper holding portion 1*a* and the upper grip portion 1*b*, a pair of fixing parts 1*d* are formed on both lateral sides of the upper holding body 1. Holes 3 are formed on the fixing parts 1*d*. The lower holding body 2 comprises a lower holding portion 2*a* and a lower grip portion 2*b* which are connected to form a single body. At the connected portion of the lower holding portion 2*a* and the lower grip portion 2*b*, a pair of fixing parts 2*d* are formed on both lateral sides of the lower holding body 2. Projections 2*c* are provided on the fixing parts 2*d*. The projections 2*c* are inserted rotatably into the holes 3 of the fixing parts 1*d* respectively. The projection 2*c* is easily inserted into the hole 3 due to a slope 2*e* provided on the end of the projection 2*c*.

The upper holding body 1 is formed into a wavy oblong plate made of synthetic resin. The lower holding body 2 is formed into an oblong plate made of synthetic resin, which is waved along the upper holding body 1.

A protrudent spring 4 as shown in FIGS. 24 and 25 is formed into one single body on the lower grip portion 2*b* of the lower holding body 2 and comes into contact with the bottom face of the upper grip portion 1*b* of the upper holding body 1. In this arrangement, the upper holding portion 1*a* and the lower holding portion 2*a* are forced to move toward each other due to the elasticity of the spring 4. The upper holding body 1 may be provided with a longitudinal hole 1*e* or a plurality of teeth 1*f* on the bottom side.

The protrudent spring 4 may be formed on the upper grip portion 1*b* of the upper holding body 1 and come into contact with the top face of the lower grip portion 2*b* of the lower holding body 2. Alternatively, protrudent upper and lower springs 4 may be provided on the upper grip portion 1*b* and the lower grip portion 2*b* respectively and come into contact with each other.

As shown in FIGS. 24 through 26, the hair holding device of the invention further comprises a stopper mechanism 10 between the upper holding body 1 and the lower holding body 2. The stopper mechanism 10 has the same structure as that in the second embodiment. Therefore, the stopper mechanism 10 causes the free end of the upper holding portion 1*a* and the free end of the holding portion 2*a* to be kept a certain distance from each other, as illustrated by the alternate double dots and dash line in FIG. 25.

As shown in FIG. 25, the hair holding device of the invention still further includes a snap mechanism 17 which consists of a catch part 15 provided on the end of the upper holding portion 1*a* and a snap part 16 provided on the end of the lower holding portion 2*a*. The snap mechanism 17 releasably engages the end of the upper holding portion 1*a* and the end of the lower holding portion 2*a*.

As shown in FIGS. 24 and 26, the catch part 15 in this embodiment comprises a catch arm 15*c*. The catch arm 15*c* is formed into one single body on the general center of the end of the upper holding portion 1a, and provided with two notches 15*d* for engagements.

As shown in FIG. 24, the snap part 16 in this embodiment consists of a hole provided on the end of the lower holding portion 2*a* of the lower holding body 2. A step 16*c* as shown in FIG. 25 may be provided on the hole.

Before the engagement, the catch part 15 and the snap part 16 are placed as illustrated by the alternate double dots and dash line in FIG. 25. In order to obtain the engagement as illustrated by solid line in FIG. 25, the snap part 16 is pressed against the catch part 15, whereby the step 16*c* is caught in the lower notch 15*d*. The snap part 16 may be further pressed against the catch part 15 to fit the step 16*c* in the upper notch 15*d*. In order to release the engagement, the engaged end of the upper holding body 1 is pulled away from the lower holding body 2, whereby the step 16*c* is released from the notch 15*d*, as illustrated by the alternate double dots and dash line in FIG. 25.

The stopper mechanism 10 of a hair holding device of the invention is not limited to the above three embodiments on condition that it keeps the free end of the upper holding portion 1*a* a certain distance from the free end of the lower holding portion 2*a*.

The snap mechanism 17 of a hair holding device of the Invention is not limited to the above three embodiments on condition that it causes the free end of the upper holding portion 1*a* and the free end of the lower holding portion 2*a* to be releasably engaged with each other.

In the process of using the hair holding device of the present invention, the upper grip portion 1*b* of the upper holding body 1 and the lower grip portion 2*b* of the lower holding body 2 are pinched and pressed by one hand so that the free end of the upper holding portion 1*a* and the free end of the lower holding portion 2*a* move far away from each other, as illustrated by the alternate single dot and dash lines in FIGS. 2, 14 and Z5. Hair to be clipped is held in the other hand and placed between the upper holding portion 1*a* and the lower holding portion 2*a*. The hand is then taken off the upper and lower grip portions 1*b* and 2*b*, whereby the upper holding portion 1*a* and the lower holding portion 2*a* return to the position as illustrated by the alternate double dots and dash lines in FIGS. 2, 14 and 25, and thus hair is caught between the upper and lower holding portions 1*a* and 2*a*. The upper holding portion 1*a* is pressed against the lower holding body 2 so that the snap mechanism 17 provides the engagement of the free end of the upper holding portion 1*a* and the free end of the lower holding portion 2*a*, as illustrated by solid lines in FIGS. 2, 14 and 25. Therefore, hair is held steadily and prevented from falling out.

Since the hair holding device of the present invention is constructed as described the above, the structure whereby the upper holding portion 1*a* and the lower holding portion 2*a* are forced to move toward each other is simple, resulting in the advantages of a short assembly time and a low manufacturing cost.

Furthermore, a hair holding device of the present invention is easy to use. As illustrated by the alternate double dots and dash lines in FIGS. 2, 14 and 25, the free end of the upper holding portion 1*a* and the free end of the holding portion 2*a* are kept a certain distance from each other when the upper grip portion 1*b* and the lower grip portion 2*b* are not pressed, so that the lower holding body 2 does not move further away from the upper holding body 1 and does not hang and waver. Therefore, it is not necessary to support the lower holding body 2 by hand in order to make the space required before hair is placed therein.

In addition, after hair is placed between the upper holding portion 1*a* and the lower holding portion 2*a*, a simple operation provides the engagement of the free end of the upper holding portion 1*a* and the free end of the lower holding portion 2*a*, so as to hold hair steadily and prevent hair from falling out. Therefore, hair is easily set with the hair holding device of the present invention or is held in the device for a long time after hair is set.

Figure 30:
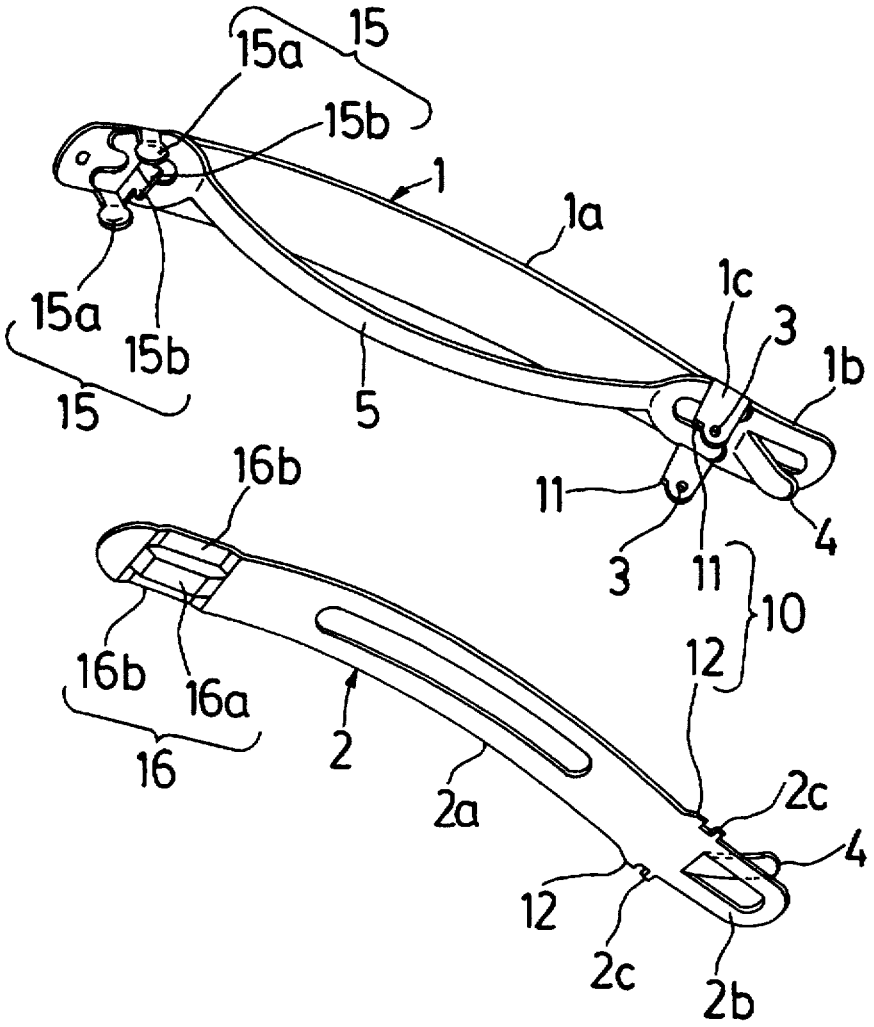
FIG. 30 is an exploded perspective view showing another embodiment of a hair holding device according to the present invention.
Figure 31:
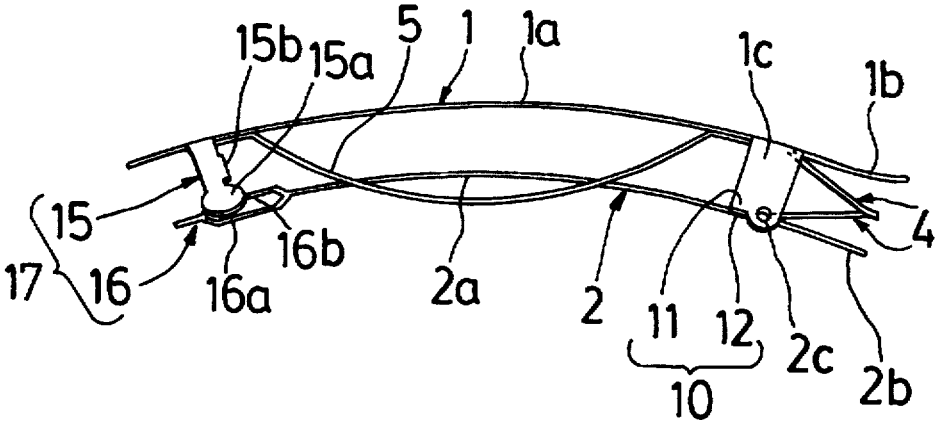
FIG. 31 is a side view of the hair holding device shown in FIG. 30.

Shown in FIGS. 30 and 31 is another embodiment of a hair holding device in accordance with the teachings of the present invention. The hair holding device of FIGS. 30 and 31 is constructed and operates substantially the same as the one shown in FIGS. 1 and 2 except for the addition of the additional protrudent spring 4 provided in the portion 1*b* of the upper body 1. In this embodiment, the protrudent spring 4 provided in the upper body 1 and the protrudent spring 4 provided in the lower body 2 contact each other to perform the function of the present invention.

It should be apparent to those skilled in the art that the above-described embodiments are merely illustrative of but a few of the many possible specific embodiments which represent the applications of the principles of the present invention. Other numerous and varied arrangements can be readily devised by those skilled in the art without departing from the spirit and scope of the present invention.

What is claimed is:

1. A hair holding device comprising:

an upper holding body having an upper holding portion which has a free end and a second end, and an upper grip portion which has a free end and a second end, wherein the second end of the upper holding portion is connected to the second end of the upper grip portion in a connection area to form a single body;

a lower holding body having a lower holding portion which has a free end and a second end, and a lower grip portion which has a free end and a second end, wherein the second end of the lower holding portion is connected to the second end of the lower grip portion in a connection area to form a single body;

fixing parts located on both lateral sides of the connection area of both of said upper holding body and said lower holding body and wherein said upper holding body and said lower holding body are rotatably connected at said fixing parts;

a snap mechanism for releasably engaging the free end of said upper holding portion and the free end of said lower holding portion with each other;

a protrudent spring provided on either one of said upper grip portion or said lower grip portion to come into contact with the other one of said upper grip portion and said lower grip portion; and a stopper mechanism which sets and keeps a predetermined distance between said upper holding portion and said lower holding portion when said holding device is open.

2. A hair holding device according to claim 1, wherein said upper holding body and said lower holding body are made of metal.

3. A hair holding device according to claim 1, wherein said upper holding body and said lower holding body are made of synthetic resin.

4. A hair holding device according to claim 1, wherein said upper holding body is made of metal and said lower holding body is made of synthetic resin.

5. A hair holding device according to claim 1, wherein said upper holding body is made of synthetic resin and said lower holding body is made of metal.

6. A hair holding device comprising:

an upper holding body having an upper holding portion which has a free end and a second end, and an upper grip portion which has a free end and a second end, wherein the second end of the upper holding portion is connected to the second end of the upper grip portion in a connection area to form a single body;

a lower holding body having a lower holding portion which has a free end and a second end, and a lower grip portion which has a free end and a second end, wherein the second end of the lower holding portion is connected to the second end of the lower grip portion in a connection area to form a single body;

fixing parts located on both lateral sides of the connection area of both of said upper holding body and said lower holding body and wherein said upper and lower holding body are rotatably connected at said fixing parts;

a snap mechanism for releasably engaging the free end of said upper holding portion and the free end of said lower holding portion with each other;

a protrudent spring provided on both of said upper grip portion or said lower grip portion to come into contact with each other; and a stopper mechanism which sets and keeps a predetermined distance between said upper holding portion and said lower holding portion when said holding device is open.

7. A hair holding device according to claim 1, wherein said upper holding body and said lower holding body are made of metal.

8. A hair holding device according to claim 1, wherein said upper holding body and said lower holding body are made of synthetic resin.

9. A hair holding device according to claim 1, wherein said upper holding body is made of metal and said lower holding body is made of synthetic resin.

10. A hair holding device according to claim 1, wherein said upper holding body is made of synthetic resin and said lower holding body is made of metal.

* * * * *